United States Patent [19]

Dasa

[11] Patent Number: 4,698,041

[45] Date of Patent: Oct. 6, 1987

[54] MULTIPLE CONFIGURATION MODEL AIRCRAFT

[76] Inventor: Madhava Dasa, R.R. 1 - Box 549, Kula, Hi. 96790

[21] Appl. No.: 762,295

[22] Filed: Aug. 5, 1985

[51] Int. Cl.[4] ..... A63H 27/18

[52] U.S. Cl. ..... 446/61

[58] Field of Search ..... 446/61, 63, 64, 65, 446/66, 67, 68, 3

[56] References Cited

U.S. PATENT DOCUMENTS 2,595,074 4/1952 Guillow ..... 446/66

FOREIGN PATENT DOCUMENTS 1051368 12/1966 United Kingdom ..... 446/61

*Primary Examiner*—Robert A. Hafer
*Assistant Examiner*—Danton DeMille
*Attorney, Agent, or Firm*—Herzig & Yanny

[57] ABSTRACT

A model aircraft kit which enables the purchaser to assemble a variety of model aircraft configurations and planforms, uses a relatively small number of components. The components of the model aircraft kit comprise at least one of several possible variations of fuselages, a wing panel or panels, and a number of stabilizing and control surfaces which may include conventional or diagonally hinged control surfaces. Releasable connectors which may include a pair of releasable wing tip appendage connectors, are used to join the components thereby providing a wide variety of planforms and configurations. At least one of the fuselages is capable of being separated into subparts one of which becoming a short fuselage being capable of accommodating some or all of the remaining components of the model aircraft kit. Several individually unique model aircraft are assembled using a pair of wing tip appendage connectors with respecting stabilizing surfaces, independent of other multiple configuration features of the aircraft kit.

1 Claim, 26 Drawing Figures

MULTIPLE CONFIGURATION MODEL AIRCRAFT

BACKGROUND OF THE INVENTION

1. Field of the Invention

The present invention relates generally to model aircraft; and, more particularly, to toy gliders which have motion imparted to them by a user's hand or by a launching device such as a catapult or by any other device capable of imparting motion. The present invention also relates generally to mechanically or electromechanically remote controlled model aircraft.

2. Description of the Prior Art

A purchaser of a model aircraft, such as a toy glider or remote controlled model aircraft, normally will choose only one of many possible aircraft configurations and planforms. The heretofore standard configuration has a main fuselage which locates a primary lifting surface toward the front of the fuselage and vertical and horizontal stabilizers at the rear of the fuselage. Each particular configuration and planform has its own aerodynamic characteristics. For example, one particular configuration and planform may enable the model aircraft to make excellent loops while another configuration and planform may enable the model aircraft to fly straight for a considerable distance. Still another configuration and planform may enable the model aircraft to reach a high altitude or fly fast. Each model air craft has its own particular aerodynamic advantages and disadvantages. The purchaser of a model aircraft will normally select one with a particular configuration and planform at time of purchase. Consequently, the purchaser must purchase more than one model aircraft to obtain varied desirable visual appearances and aerodynamic characteristics.

The most salient differences in model aircraft usually arise in the relative size and shape of the fuselage and the relative size, shape and placement of the lifting and stabilizing surfaces on the fuselage. The fuselage of a model aircraft is generally cylindrical and its shape resembles that of a fullsize aircraft. However, the fuselage may have various other shapes, for instance, it may be thin and pointed or wide and blunt. The shape and other features of the fuselage facilitate the placement of aerodynamic structural members, such as the primary lifting surface which in turn determines the final aerodynamic characteristics of the model aircraft.

Just as there are a wide variety of fuselage sizes and shapes available, there are also a wide variety of primary lifting surface sizes and shapes available for model aircraft. For instance, the primary lifting surface may have a swept delta shape or a straight full span configuration. In addition, the placement of the primary lifting surface on the fuselage may vary from model to model. The placement and shape of the primary lifting surface has a very pronounced effect on the visual appearance and aerodynamic characteristics of the model aircraft. Thus, the shape of the primary lifting surface and its placement on the fuselage is another factor which the purchaser must consider when chosing a model aircraft.

Other important contributing factors affecting the visual appearances and aerodynamic characteristics of the model aircraft are the stabilizing surfaces. The placement of the stabilizing surfaces has a pronounced effect on the appearance and handling characteristics of the model aircraft. An empennage may have one or more vertical stabilizers or none at all. Obviously, the number and size of the stabilizers or their absence can severely affect the appearance and yaw stability of the model aircraft. Moreover, the stabilizing surfaces can have various configurations and placement locations on the fuselage further affecting the appearance and aerodynamic characteristics of the model aircraft. Stabilizing surface variations can be similar in scope to the variations in the primary lifting surface. Thus, the configuration and placement location of the stabilizing surfaces must be considered by the model aircraft purchaser when selecting a model aircraft.

The purchaser should be knowledgeable in order to make an informed decision with respect to the purchase of a particular model aircraft. However, especially with toy aircraft, the typical purchase does not have sufficient aerodynamic expertise to make such a decision from all the possible choices. Neither is it typically practical or feasible to personally flight test each toy glider to see if the characteristics are those desired. Indeed, extensive trials of each glider may be required in order to determine if the glider is or is not suitable.

Thus, the purchaser has no alternative but to buy a model aircraft and then test it later to see if it is suitable. Available model aircraft usually have little or no design variability. Model aircraft typical provide little or no adjustment of the placement of the primary lifting surface or of any of the other components which together define the aerodynamic characteristics of the model aircraft. Consequently, the purchaser cannot significantly alter the configuration or planform of the model aircraft after the purchase. These and other disadvantages are solved using a multiple configuration model aircraft.

SUMMARY OF THE INVENTION

An object of the present invention is to provide the purchaser with a versatile model aircraft which may have a variety of configurations and planforms. The present invention provides a kit which may be assembled into variously configured model aircraft. The kit enables the assemblage of a variety of model aircraft configurations and planforms by using a relatively small number of parts. The model aircraft kit of the present invention has component parts comprising a fuselage and its constitment subparts along with a primary lifting surface, A horizontal stabilizer, and a pair of stabilizing surfaces which may be used alternately as diffuser panels, or single or twin vertcal stabilizers. By icorporating releasable connectors, including a pair of releasable wing tip appendage connectors, the component parts may be assembled such that the model aircraft obtains various possible configurations and planforms as desired.

A wing connector is slotted in order to receive the two wing panels. The wing connector may also have another slot which is substantially perpendicular relative to the primary lifting surface slots so as to receive the fuselage. The wing connector can be slid along the length of the fuselage thereby placing the primary lifting surface in any desired position along the length of the fuselage. The slots for the primary lifting surface are formed such that the primary lifting surface may be mounted on the fuselage in the proper angular relationship.

The present invention provides a configurable model aircraft in which the component parts can be alternately assembled in varius configurations, including, but not limited to the standard, canard and flying wing configurations.

Another aspect of the present invention provides differing configurable fuselages including subparts providing additional model aircraft configurations. Additionally, other component parts of the model aircraft may be mounted on the fuselage at a variety of positions.

Still another aspect of the present invention provides a a pair of releasable wing tip appendage connectors each of which is designed to hold together a wing panel and a respective diffuser panel in a converging anhedral relationship.

A further aspect of the invention provides a pair of releasable wing tip appendage connectors each of which is capable of mounting a vertical stabilizer at the respective end tips of each wing panel of the primary lifting surface.

Still a further aspect of the present invention provides releasable wing tip appendage connectors which are sturdy enough to maintain the appending surfaces in a desired relative position, yet the connectors are lightweight so that they do not significantly affect the center of gravity or weight of the model aircraft.

Yet another aspect of the present invention provides for changing the alignment and orientation of the primary lifting surface and selected stabilizing surfaces by disconnecting the surfaces from their releasable connectors and reattaching them thereby yielding further configurations of the model aircraft.

Yet a further aspect of the present invention provides diagonally hinged control surfaces on the diffusers or vertical stabilizers which surfaces provide the model aircraft with axial control when the control surfaces are oriented in alternative directions. These and other advantages will become more apparent in the following description of the preferred embodiments.

BRIEF DESCRIPTION OF THE DRAWINGS

FIG. 9(*b*) is a side view of a separate flying wing fuselage used as illustrated in FIG. 1.

FIG. 10(*b*) is a perspective view of one of the pair of releasable wing tip appendage connectors for connecting together a diffuser panel and a wing panel.

FIG. 10(*c*) is a perspective view of one of the pair of releasable wing tip appendage connectors for connecting together a wing panel and a vertical stabilizer.

FIG. 10(*d*) shows a connector for mounting two wing panels to the fuselage.

DETAILED DESCRIPTION OF THE PREFERRED EMBODIMENTS

A First Embodiment

Figure 1:
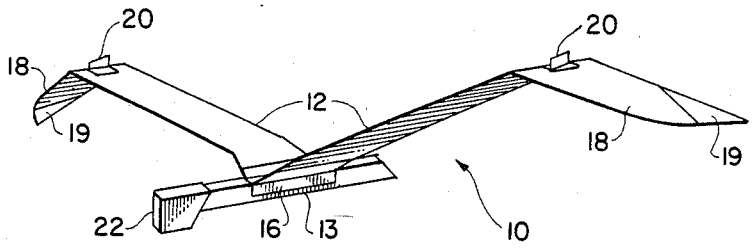
FIGS. 1, 2, 3, 4 and 5 are perspective views illustrating some of the possible configurations of a first embodiment.

A model aircraft may be hand launched, launched from an appropriate catapult or other suitable device, and may be mechanically or electro mechanically remote controlled. The launching means is not shown in the drawings.

Referring to FIGS. 1 through 5, a particular configuration of the model aircraft 10 is commonly referred to as a "flying wing" since it does not have an appreciable tail section. The model aircraft 10 has a primary lifting surface comprising two wing panels 12 attached approximately at the center of a fuselage 13 by means of a releasable and slideable connector 16. Diffusers 18 each of which has a control surface 19, are connected to the tip of each respective wing panel 12 by a pair of releasable wing tip appendage connectors 20. The fuselage 13 has an attached weight 22 which facilitates proper aerodynamic balance during flight and cushions against shock from a frontal impact.

The connector 16 is preferably made of plastic and slotted in order to receive the two wing panels 12. The connector 16 also has another slot which is substantially perpendicular to the primary lifting surface and which receives the fuselage 13. Each wing tip appendage connector 20 is preferably made of plastic and has a slot which receives a diffuser 18. The wing tip appendage connectors 20 also have another slot into which each wing panel 12 is inserted at a suitable angle.

Figure 2:
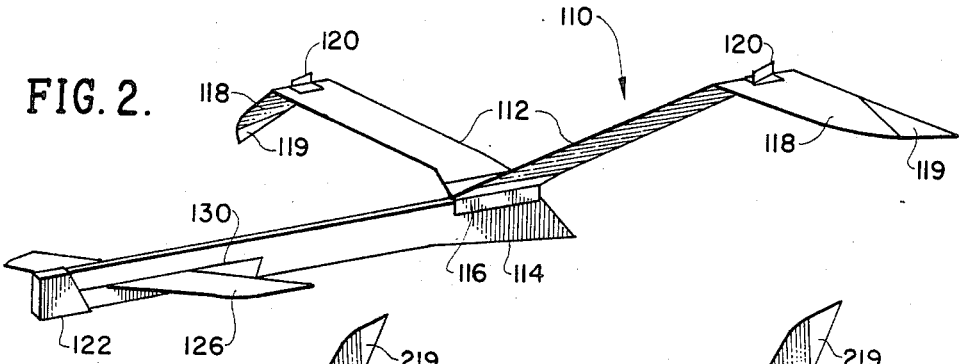

A model aircraft 110 which is similar to the configuration of the model aircraft 10 depicted in FIG. 1 except that the configuration in FIG. 2 employs a different fuselage 114 with a horizontal stabilizer 126 at the front of the fuselage and employs two wing panels 112 which are attached directly to the back of the fuselage 114 by means of a releasable and slideable connector 116.

The fuselage 114 has a transverse slot 130 extending through the body of the fuselage from near the front end of the fuselage to approximately its center. This configuration also utilizes a pair of diffusers 118, a pair of releasable wing tip appendage connectors 120, and a weight 122 all of which have similar functions and compositions to their companion parts as shown in FIG. 1. The diffusers 118 have respective control surfaces 119.

Figure 3:
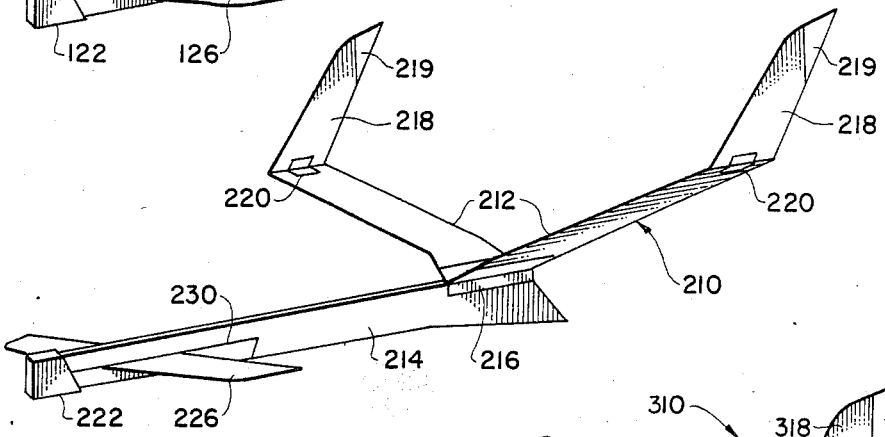

FIG. 3 depicts a model aircraft 210, which is similar to the configuration depicted in FIG. 2 except that the configuration shown in FIG. 3 employs vertical stabilizers 218 in place of diffusers. The vertical stabilizer 218 have respective control surfaces 219. The configuration shown in FIG. 3 has a fuselage 214 with a transverse slot 230. Also, wing panels 212, connector 216, wing tip appendage connectors 220, weight 222 and the horizontal stabilizer 226 have similar functions and compositions to their companion parts depicted in FIG. 2

Figure 4:
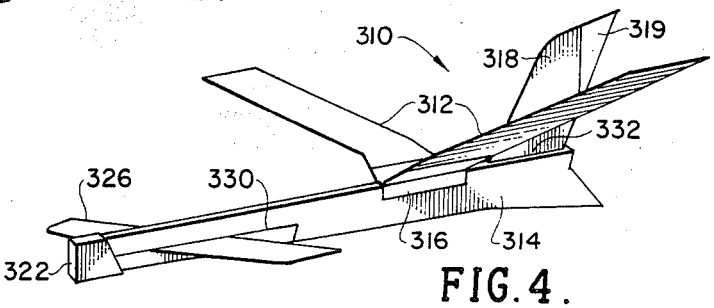

FIG. 4 depicts another configuration of a model aircraft 310 having two wing panels 312, fuselage 314, connector 316, weight 322, horizontal stabilizer 326 and transverse slot 330 which have similar functions and compositions to their companion parts depicted in FIGS. 2 and 3. The fuselage 314 uses a groove 332, preferably located along the upper edge of the rear end of the fuselage 314, which groove 332 receives a vertical stabilizer 318. The vertical stabilizer 318 also has a control surface 319.

Figure 5:
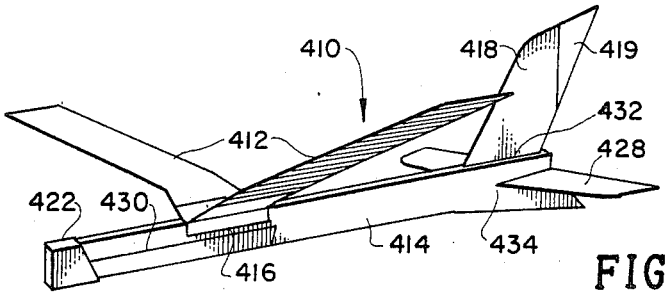

FIG. 5 depicts yet another configuration of a model aircraft 410 which is similar to the configuration depicted in FIG. 4 except that a fuselage 414 has a rear slot 434 that receives a rear horizontal stabilizer 428. The slot 434 preferably makes an acute angle relative to the top edge of the fuselage 414. Two wing panels 412, connector 416, vertical stabilizer 418, control surface 419, weight 422, forward transverse slot 430 and vertical stabilizer groove 432 are similar in function and composition to their companion parts depicted in FIG. 4. The fuselage 414 can be used as the fuselages depicted in FIGS. 2 through 5, since it accommodates two slots 434 and 430 and a groove 434.

Figure 6:
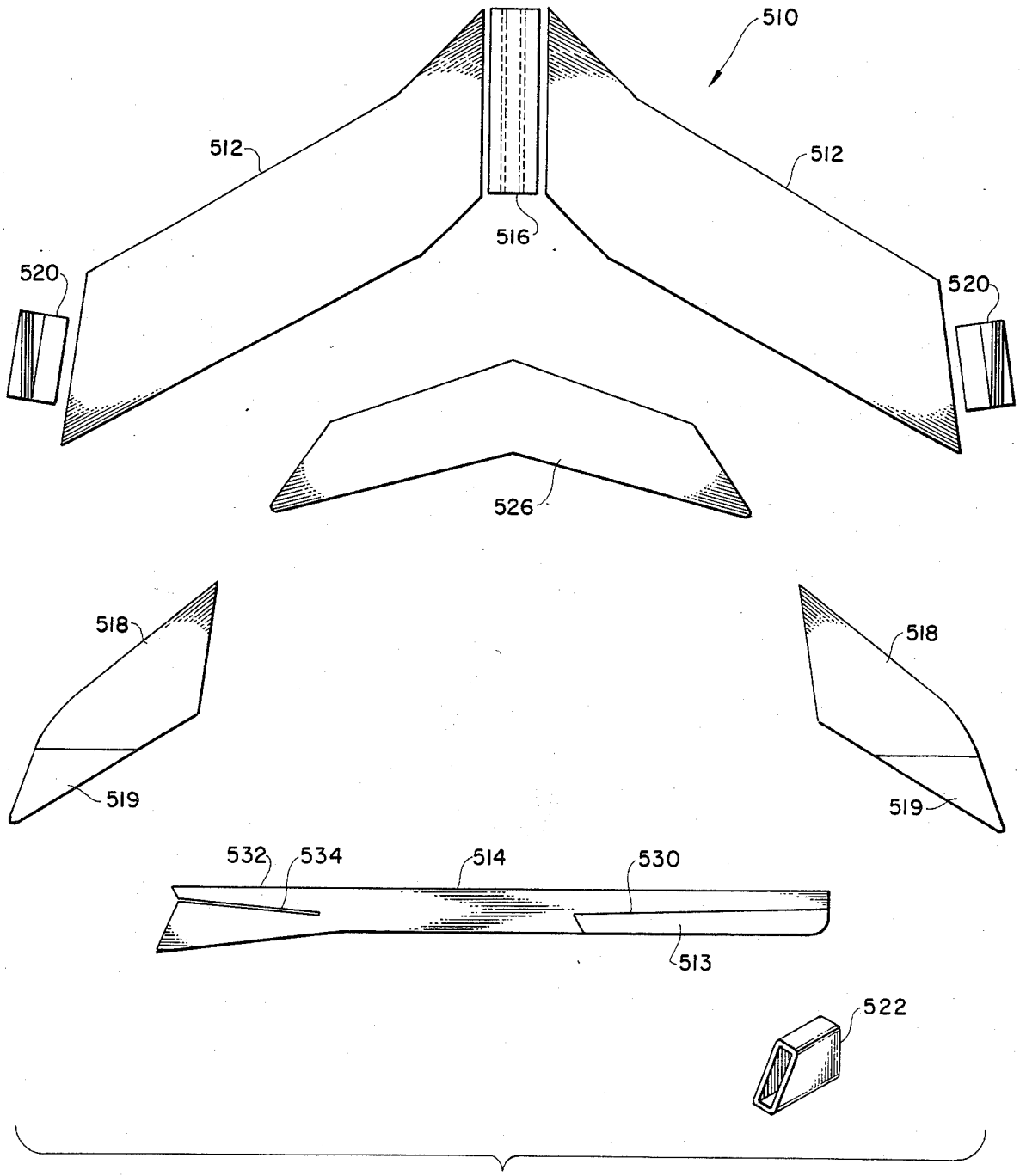
FIG. 6 is a separated view of the component parts of the embodiment partially illustrated in FIGS. 1 through 5.

Referring to FIGS. 1 through 6 and more specially to FIG. 6, component parts 510 are assembled providing various configurations of the model aircraft 10, 110, 210, 310 and 410. These component parts 510 are a composite fuselage 514 including a flying wing fuselage 513, two wing panels 512, a connector 516 which receives and connects together the fuselage 514 and the two wing panels 512, diffusers or vertical stabilizers 518, releasable wing tip appendage connectors 520 which connect each diffusers or vertical stabilizers 518 to respective wing panels 512, a horizonal stabilizer 526 and a weight 522. The weight 522 is to be mounted on the nose of fuselage 514. The fuselage 514 has preferably a forward transverse slot 530, a rear groove 532 and a rear slot 534. The diffusers and vertical stabilizers 518 each have a control surface 519.

It is understood and is readily apparent from viewing FIGS. 1 through 6 that the component parts 510 are considered in combination as a model aircraft kit capable of producing at least the various configured model aircraft 10, 110, 210, 310 and 410 when the component part 510 are particularly assembled.

It is equally apparent that the fuselage 514 is a composite of two subparts one of which is a detachable portion 513 which when alone acts as a separate fuselage 13 as depicted in FIG. 1.

A Second Preferred Embodiment

Figure 7A:
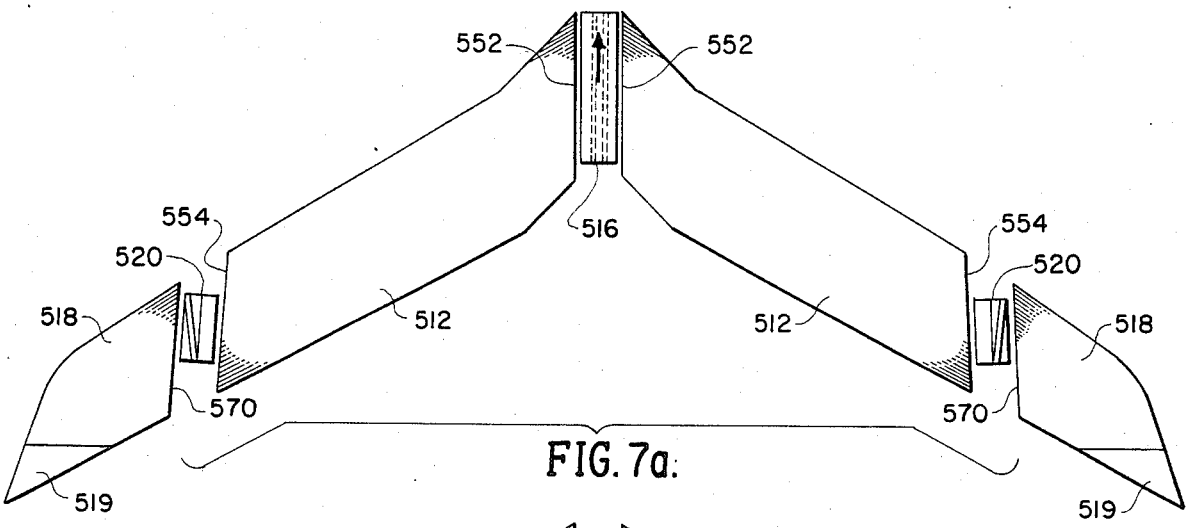
FIGS. 7(*a*), 7(*b*) and 7(*c*) are top views of three different configurations of primary lifting surfaces and diffusers or vertical stabilizers of a second embodiment.
Figure 7B:
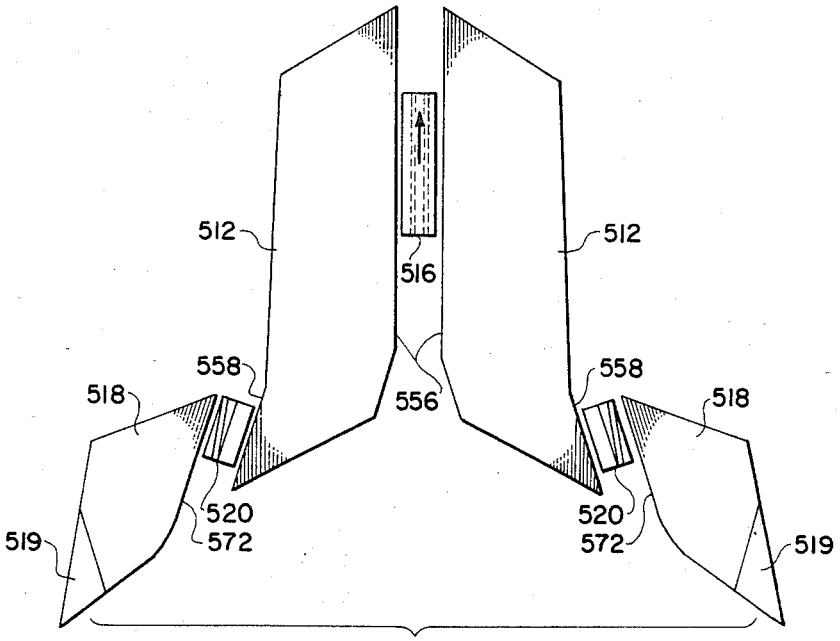
Figure 7C:
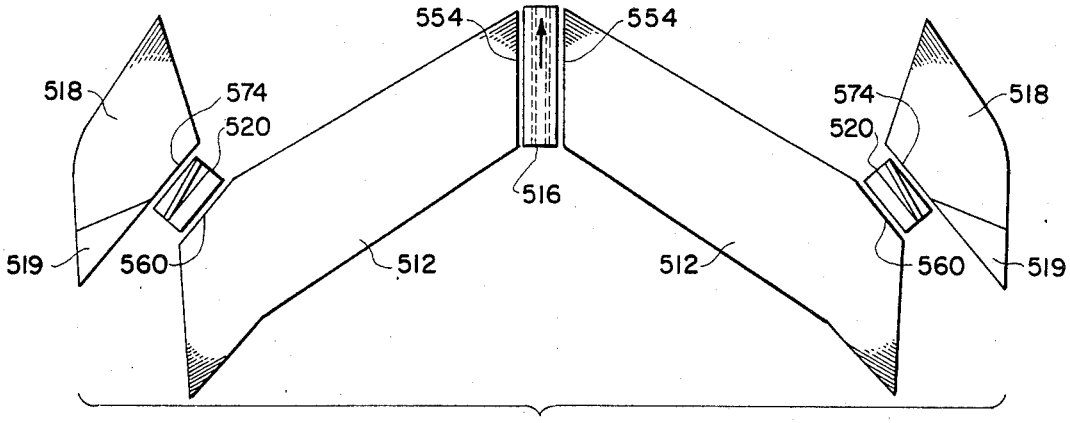

Reffering to FIG. 7(*a*), the design of the wing panels 512 and the connector 516 enables multiple orientations of the two wing panels 512 and hence multiple orientations of connecting diffusers or vertical stabilizers 518 each of which has a respective control surface 519.

The two wing panels 512 are aligned with the connector 516 along edges 552 of the two wing panels 512. The diffusers or vertical stabilizers 518 with respective control surfaces 519 are additionally aligned with respective releasable wing tip appendage connectors 520 along edge 570 of the diffusers or vertical stabilizers 518, which wing tip appendage connectors 520 are in turn aligned for attachment to edges 554 of the wing panels 512.

Referring to FIG. 7(*b*), the two wing panels 512 are aligned with the connector 516 along edges 556 of the two wings panels 512. The diffusers or vertical stabilizers 518 with respective control surfaces 519 are aligned with the respective releasable wing tip appendage connectors 520 along edges 572 of the diffuser or vertical stabilizers 518, which wing tip appendage connectors 520 are in turn aligned for attachment to respective edges 558 of the two wing panels 512.

Referring to FIG. 7(*c*), the two wing panels 512 are aligned with the connector 516 along respective edges 554 of the two wing panels 512. The diffusers or vertical stabilizers 518 with respective control surfaces 519 are aligned with the respective releasable wing tip appendage connectors 520 along respective edges 574 of the diffusers or vertical stabilizers 518, which wing tip appendage connectors 520 are in turn aligned for attachment to respective edges 560 of the two wing panels 512.

Figure 8:
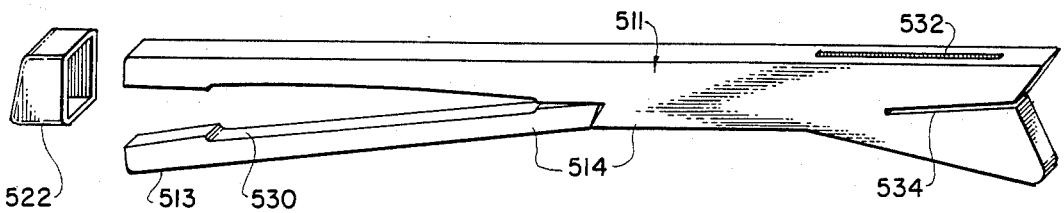
FIG. 8 is a perspective view of the fuselage as illustrated in FIGS. 1 through 6.

Each configuration of model aircraft 10, 110, 210, 310 and 410 of FIGS. 1 through 5 may utilize the principle of reorientation of the two wing panels 512 and diffusers or vertical stabilizers 518 as illustrated in FIGS. 7(*a*), 7(*b*) and 7(*c*) to multiply the total number of possible configurations and planforms Referring to FIG. 8 which illustrates the composite Fuselage 514 as shown in FIGS. 1 through 6, the fuselage 514 comprises a primary fuselage component 511 and a secondary or lying wing fuselage component 513 which fits in a notched portion in the primary fuselage component 511. The secondary fuselage component 513 may be separated from the primary fuselage component 511. The weight 522 is shown as separate from the fuselage 514, but the weight 522 is adapted to be mounted on the nose of the fuselage 514 in order to connect together the primary fuselage component 511 to the secondary fuselage component 513. The weight 522 may be attached to the secondary fuselage component 513 as depicted in FIG. 1. The primary fuselage component 511 has a slot 534 at the rear which make an acute angle with respect to the top edge of the primary fuselage component 511. The slot 534 receives the horizontal stabilizer 526. A groove 532 at the top rear edge of the fuselage 514 is adapted for receiving a vertical stabilizer 518 as depicted in FIGS. 4 and 5. A transverse slot 530 extending from near one end to the center of the fuselage 514 is for receiving a horizontal stabilizer 526.

A Third Preferred Embodiment

Figure 9A:
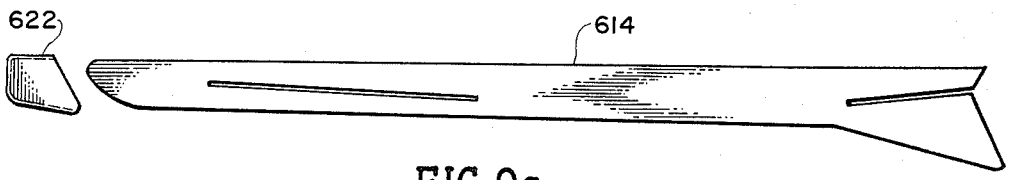
FIG. 9(*a*) is a side view of a different fuselage that may be used as illustrated in FIGS. 2 through 6.
Figure 9B:
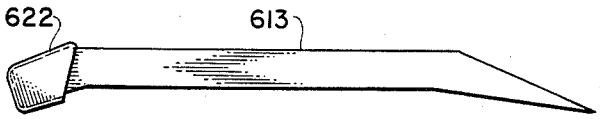
Figure 10A:
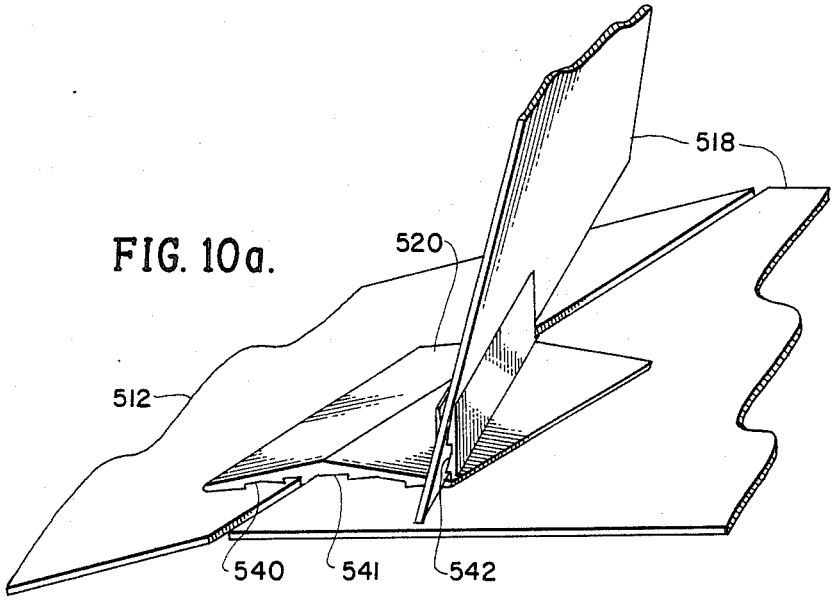
FIG. 10(*a*) is a perspective view of one of the pair of releasable wing tip appendage connectors depicted in FIGS. 1, 2, 3, 6 and 7 and shows a vertical stabilizer and a diffuser connected to one of the wing panels.
Figure 10B:
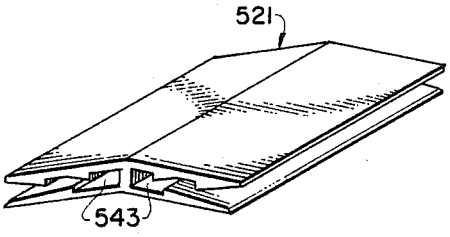
Figure 10C:
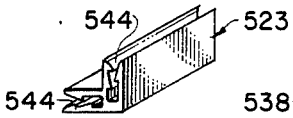
Figure 10D:
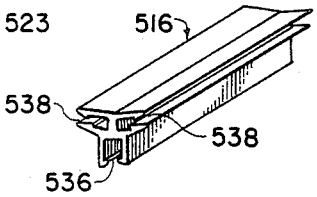

Referring to FIGS. 9(*a*) and 9(*b*), fuselages 613 and 614 may be used in connection with the configurations depicted in FIGS. 1 through 5.

The fuselage 614 with a nonattached weight 622 is similar to that of fuselage 514 shown in FIG. 8, except that the fuselage 614 is unitary rather than constructed of a primary fuselage component 511 and a secondary fuselage component 513. The weight 622 attached to fuselages 613 and 614 is identical to the weight 522 shown in FIG. 8.

As is evident from the foregoing, the fuselages 514, 613 and 614 provide a capability whereby the wing panels 512 and diffusers or vertical stabilizers 518 may be connected at various positions on any of the above fuselages 514, 613, 614. By utilizing the pair of releasable wing tip appendage connectors 520, the diffusers or vertical stabilizers 518 may be connected at various relative angles to the two wing panels 512 which can have multiple orientations. Accordingly, because so many different configurations are possible, the model aircraft has a wide variety of possible different aerodynamic characteristics and visual appearances.

A Fourth Preferred Embodiment

Referring to FIG. 10(*a*), one of the pair of wing tip appendage connectors 520 may simultaneously connect one of the two wing panels 512 to a diffuser 518 and a vertical stabilizer 518. The wing tip appendage connector 520 has a slot 540 for receiving a wing panel 512 and two slots 541 and 542 for respectively receiving a diffuser 518 and a vertical stabilizer 518. The slot 542 forms a diagonal angle across the top of the connector 520 for receiving and positioning the vertical stabilizers 518. The wing tip appendage connector 520 is attached to a wing panel 512 respecting particular construction of the releasable wing tip appendage connector 520. This angle allows a wing tip appendage to be in proper alignment with respect to the direction of flight of the model aircraft. The vertical stabilizer 518 is typically positioned in parallel to a fuselage.

Referring to FIG. 10(*b*), one of a pair of another wing tip appendage connector 521 connects only a diffuser panel 518 to one of the two wing panels 512. The diffuser wing tip appendage connector 521 has a pair of slots 543 either of which may receive the diffuser 518 or a wing panel 512.

Referring to FIG. 10(*c*), one of a pair of yet another alternate wing tip appendage connectors 523 connects only a vertical stabilizer 518 to the one of the two wing panels 512. The wing tip appendage connector 523 has a pair of slots 544 either of which may receive the vertical stabilizer 518 or one of the two wing panels 512.

The wing tip appendage connectors 520, 521 or 523 enable differing desirable visual appearance and aerodynamic characteristics of the model aircraft by facilitating differing connections of the diffusers or vertical stabilizers 518 to the wing panels 512. The releasable wing tip appendage connectors 520, 521 or 523 can be constructed such that the diffuser or vertical stabilizer 518 is attached at any of a variety of desired angles. Since the pair of wing tip appendage connectors 520, 521 or 523 are preferably composed of a lightweight plastic material, they do not significantly add to the weight of the model aircraft and thus do not significantly interfere with or detract from the desired aerodynamic characteristics of the model aircraft.

Referring to FIG. 10(*d*), the wing connector 516 is also made of light weight material and comprises slots 538 for connecting together a fuselage 514, 513, 614 or 613 and the two wing panels. The slots 538 may be formed at differing angles though in the present preferred embodiment, the slot are so formed so that the primary lifting surface comprising the two wing panels 512 are in preferred angular position in respect to the fuselage 513, 514, 613, 614 as depicted in FIGS. 1 through 5.

A Fifth Preferred Embodiment

Figure 11A:
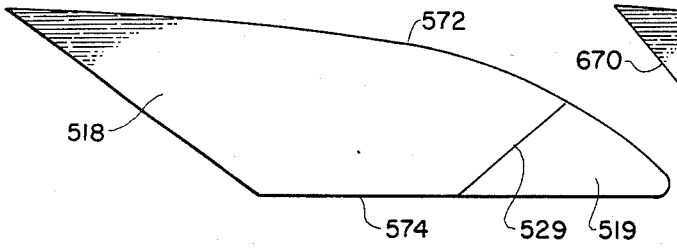
FIGS. 11(*a*) and (*b*) illustrate alternate locations of diagonally hinged control surfaces of the diffuser or vertical stabilizers illustrated in FIGS. 1 through 7.
Figure 11B:
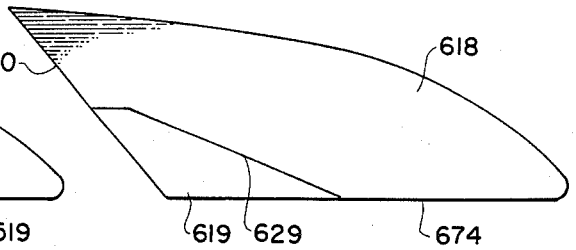

Referring to FIG. 11(*a*) and 11(*b*), the diagonally hinged control surface 519 stems from the diagonal hinge line 529 which hinge line runs between edges 572 and 574 of the wing tip The diagonal hinge line 529 is formed, for example by a series of perforations, so that the diagonally hinged control surface may take a desired angular position with respect to the wing tip appendage 518.

Referring to FIG. 11(*b*), an alternate diagonally hinged control surface 619 stems from the diagonal hinge line 629 which runs between edges 670 and 674 of the wing tip appendage 618. The wing tip appendage 618 is an example of other possible wing tip appendage designs.

A Sixth Preferred Embodiment

Figure 12:
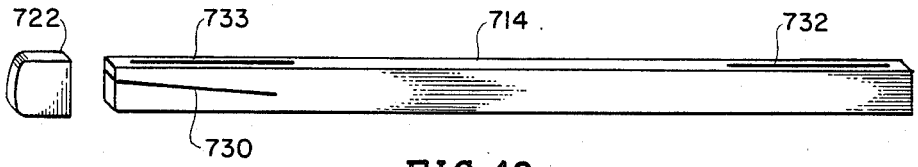
FIG. 12 illustrates another fuselage showing a weight capable of being mounted at either end of the fuselage which also has slots for attaching a vertical stabilizer to either end of the fuselage.

Referring to FIG. 12, another fuselage 714 may accommodate a weight 722 at either end. Two grooves 732 and 733 located along the top surface near both ends of the fuselage 714 may accommodate a vertical stabilizer (not shown). Thus, by simply moving the weight 722 and appropriately positioning a horizontal stabilizer (not shown) in a transverse slot 730 located toward one end of the fuselage 714, the horizontal stabilizer may be placed at either the front or back of the model aircraft. By appropriately positioning a vertical stabilizer (not shown) in either groove 732 or 733, the vertical stabilizer may be placed at the rear of the model aircraft regardless of the placement of the weight 722.

Figure 13A:
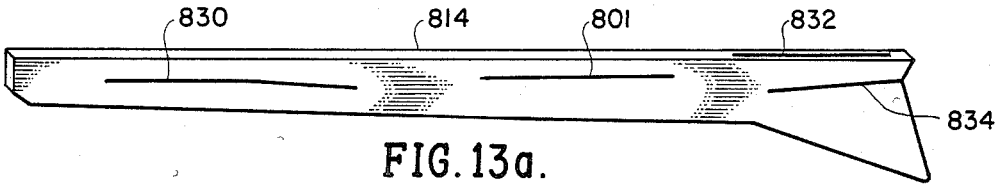
FIGS. 13(*a*) and 13(*b*) are a perspective view of yet another fuselage along with its companion separate flying wing fuselage.
Figure 14A:
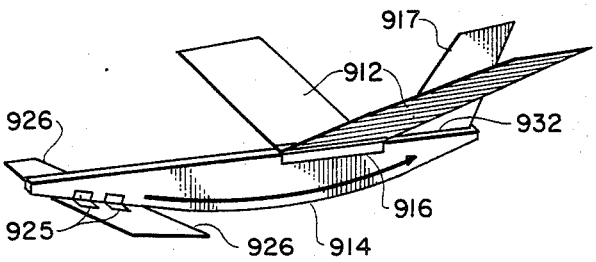
FIGS. 14(*a*)–14(*e*) show another embodiment incorporating yet another fuselage and illustrates different configurations.
Figure 13B:
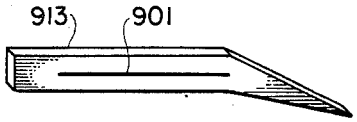
Figure 14D:
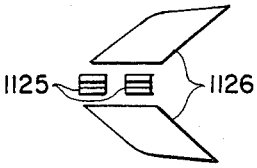
Figure 14B:
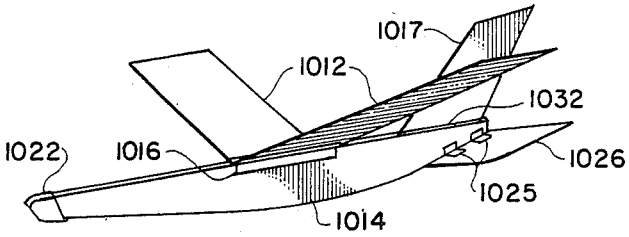
Figure 14C:
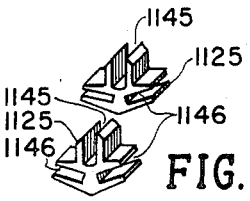

Referring to FIG. 13(*a*), a fuselage 814 having a transverse slot 801 extending within but not approaching the ends of fuselage 814 receives a unitary wing panel (not shown). The fuselage 814 further includes a slot 834 at the rear which slot 834 makes an acute angle with respect to the top edge of the fuselage 814, which then receives a horizontal stabilizer 526 and which may receive a unitary primary lifting surface (not shown). The fuselage 814 also includes a groove 832 at the top rear edge of the fuselage 814, which groove 832 is adapted for receiving a vertical stabilizer 518 as depicted in FIG. 6. The fuselage 814 further includes a transverse slot 830 extending from near the front end to approximately the center of the fuselage 814 for receiving a horizontal stabilizer 526 or a unitary wing panel (not shown).

Referring to FIG. 13(*b*), a flying wing fuselage 913 having a transverse slot 901 extending within but not approaching the ends of fuselage 913, receives a unitary wing panel (not shown). The slot 901 also may extend from either end of the fuselage 913 approaching but not touching the opposite end.

A Seventh Preferred Embodiment

Referring to FIGS. 14(*a*) and 14(*b*), an alternate fuselage 914 or 1014 with attached two-piece horizontal stabilizer 926 or 1026 provides further possible configurations of a model aircraft.

The configurations of the model aircraft depicted in FIGS. 14(*a*) and 14(*b*) correspond to the configurations of FIGS. 4 and 5, respectively. The fuselages 914 or 1014 each have preferably only one groove 932 or 1032, respectively, each of which receives a vertical stabilizers 917 or 1017, respectively. As with the configurations of FIGS. 2 through 5, these two configurations include two wing panels 912 and 1012, connectors 916 and 1016, pairs of releasable wing tip appendage connectors 925 and 1025, and horizontal stabilizers 926 and 1026, respectively. The configuration illustrated in FIG. 14(*b*) may require a nose weight 1022.

The horizontal stabilizers 926 and 1026 are connected to the bottom of the convexly curved fuselages 914 and 1014, respectively, by a pair of releasable wing tip appendage connectors here designated as non-primary flight surface connectors 925 and 1025, respectively.

The horizontal stabilizer 926 and 1026 preferably comprise two non-primary flight surfaces which when appropriately positioned may also function as wing tip appendages, for example, diffusers on a wing panel 912 or 1012. Since the non-primary flight surface connectors 925 and 1025 are releasable and slideable, the non-primary flight surfaces (horizonal stabilizers) 926 and 1026 can be positioned anywhere along the fuselage 914 and 1014.

Referring to FIGS. 14(*a*), 14(*b*), 14(*c*) and 14(*d*), a pair of releasable non-primary flight surface connectors 1125 are identical to the connectors 925 and 1025. The non-primary flight surface connectors 1125 have slots 1145 which may receive the fuselage 914 or 1014. Non-primary flight surfaces 1126 are identical to surfaces 926 and 1026. A pair of slots 1146 receive non-primary flight surfaces 926, 1026 and 1126 as shown in FIGS. 14(*a*) and 14(*b*). FIG. 14(*e*) shows a non-primary flight surface connector 1125 joining wing panel 1112 to non-primary flight surface (diffuser) 1126.

An Eighth Preferred Embodiment

Figure 15:
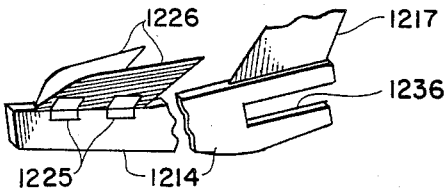
FIG. 15 illustrates alternate aspects of the embodiment illustrated in FIG. 14 with the wing appendage connectors connecting flight surfaces to a notched fuselage at a forward location.

Referring to FIG. 15, an alternate fuselage 1214 is designed similar to the fuselage 914 or 1014 shown in FIGS. 14(*a*) and 14(*b*) which fuselage 1214 supports a vertical stabilizer 1217, alternate non-primary flight surface connectors 1225, and non-primary flight surfaces 1226 in the forward position. An edge 1236 on a notch in the rear of fuselage 1214 may receive the non-primary flight surface connectors 1225 for positioning the non-primary flight surfaces 1226 at the rear of the fuselage 1214 thereby further increasing possible configurations of a model aircraft.

According to all of the preferred embodiments as described and depicted, each component part of the model aircraft kit may have one of several differing specific designs. For example, the fuselage may be of a composite structure including a detachable fuselage as depicted in FIGS. 6 and 8. The kit may include one or more unitary fuselages as, for example, depicted in FIGS. 1, 9, 12, 13, 14 and 15. Furthermore, each distinct fuselage may include grooves, slots, notches and contoured surfaces each of which having a unique design so as to increase the number of possible model aircraft configurations.

As there are many possible differing fuselage designs, so there are many possible differing connector designs as depicted in FIGS. 10(*a*), 10(*b*), 10(*c*), 10(*d*) and 14(*c*) and many possible differing plane surface designs as depicted in FIGS. 6, 7(*a*), 7(*b*), 7(*c*), 11(*a*) and 11(*b*) thereby providing many model aircraft configurations each having differing visual appearances and aerodynamic characteristics. Hence, the design of the component parts of a model aircraft kit are well considered in light of the desired configurations. Each piece is designed to accommodate varied uses and positions within the model aircraft.

An example of a well considered design is that design of the diffuser 518 in FIG. 6 which diffuser 518 has a particularly located diagonal hindge line. The diagonally hindged control surface 519 acts as an elevator, rudder, aileron or elevon depending upon the positioning of the diffuser or stabilizer 518.

Well considered designs of the fuselages, connectors and plane surfaces provide for a wide variety of model aircraft configurations but with the kit and the resulting assembled model aircraft having a relatively few inexpensive parts. The varied configurations enable a purchaser to select planforms with corresponding varied control, lift and stabilization.

Additionally, several individually unique model aircraft are assembled using a pair of wing tip appendage connectors with respecting stabilizing surfaces, independent of other multiple configuration features of the aircraft kit.

It is understood that the described preferred embodiments are merely illustrative of some of the many specific embodiments which represent applications and principals of the present invention. Clearly, numerous and varied other arrangements may be devised by those skilled in the art without departing from the spirit and scope of the invention.

I claim:

1. A model aircraft kit including constituent parts which are adapted to be assembled together in connected relationship in differing model aircraft configurations providing correspondingly different model aircraft appearances and aerodynamic characteristics, comprising:

fuselage members, at least one of said fuselage members comprising a body including means by which some of said parts can be assembled thereto, comprising slots, grooves, notches, and surfaces thereon and therein in combination serving as releasable supports for at least some of said parts, said one fuselage member thereby being adapted for supporting other of said constituent parts, said one fuselage member further comprising at least two unitary subparts, each having means adapting it to be detachably joined to the other anyone of said subparts being adapted to function, when detached, as a separate fuselage in one of said configurations;

a plurality of plane surface members for providing differing planforms for said configurations, each of said plurality of plane surface members being adapted to be generally supported by at least one of said fuselage members, at least some of said plurality of plane surface members being adapted to support another of said plurality of plane surface members; and connector means for connecting at least some of said plurality of plane surface members to at least some of said fuselage members at differing positions and for connecting one or more of said plurality of plane surface members to another one of said plurality of plane surface members.

* * * * *